United States Patent [19]

Kühnert

[11] Patent Number: 4,777,808

[45] Date of Patent: Oct. 18, 1988

[54] CLOTH DRAW-OFF ROLLER FOR KNITTING MACHINES

[75] Inventor: Gottfried Kühnert, Aalen, Fed. Rep. of Germany

[73] Assignee: Universal Maschinenfabrik, Westhausen, Fed. Rep. of Germany

[21] Appl. No.: 76,451

[22] Filed: Jul. 16, 1987

[30] Foreign Application Priority Data

Jul. 16, 1986 [DE] Fed. Rep. of Germany ..... 3624043

[51] Int. Cl.[4] ..... D04B 15/88

[52] U.S. Cl. ..... 66/149 R; 66/152

[58] Field of Search ..... 66/149 R, 150, 152

[56] References Cited

U.S. PATENT DOCUMENTS 3,618,343 11/1971 Essig ..... 66/150 X 4,592,214 6/1986 Goller et al. ..... 66/150 X

FOREIGN PATENT DOCUMENTS 2114664 6/1972 France .

2551097 3/1985 France .

2116591 9/1983 United Kingdom .

OTHER PUBLICATIONS

European Search Report.

*Primary Examiner*—Ronald Feldbaum

*Attorney, Agent, or Firm*—Sughrue, Mion, Zinn, Macpeak, and Seas

[57] ABSTRACT

A cloth draw-off roller for flat knitting machines has individual roller elements rotatably mounted on a draw-off shaft and intermediate rings arranged with axial play relative thereto between the roller elements, which intermediate rings are rigidly secured to the draw-off shaft and are resiliently connected to respect roller elements. In order to ensure mutually independent operation of the roller elements, means are provided which establish a minimum axial spacing between mutually facing surfaces of axially sequential intermediate rings, which spacing is larger than the axial spacing of the two faces of the respective roller element coming into contact with these surfaces.

7 Claims, 2 Drawing Sheets

CLOTH DRAW-OFF ROLLER FOR KNITTING MACHINES

Figure 1:
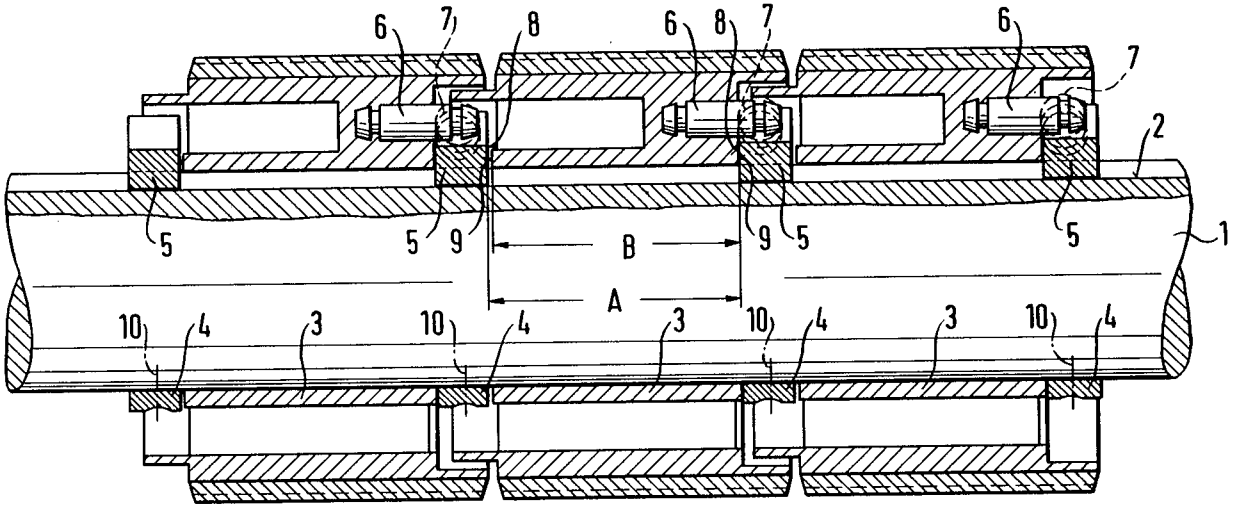

The invention relates to a cloth draw-off roller for flat knitting machines with individual roller elements rotatably mounted on a draw-off shaft and intermediate rings arranged between the roller elements with axial play relative thereto and overlapped by the roller elements, which intermediate rings are secured for common rotation with the draw-off shaft and are rotatably connected to respective roller elements. Such a cloth draw-off roller is known for example from DE-PS-3331052.

In all knitting machines, it is necessary to hold the stitches hanging in the needle hooks under tension because otherwise errors can occur during operation of the needle for knitting the next stitch or row of stitches. That is to say, the needle tongue which opens and closes the needle hooks during knitting as a result of its pivoting motion, would not be correctly controlled in the presence of a loosely hanging stitch.

In order to maintain the stitches under tension, various cloth draw-off arrangements have been proposed. The cloth draw-off arrangement most often used in flat knitting machines is of the type described above having a cloth draw-off roller. The knitting is drawn out from the roller elements. These short roller elements are pushed onto the draw-off shaft provided with a keyway and provided with a pin into which a tension spring is suspended. Each roller element is provided with a disc or an intermediate ring which has a lug extending into the keyway and is thus rigidly secured to the draw-off shaft. The tension spring of each roller element is connected at the other end with the relevant intermediate ring so that the roller elements can rotate resiliently relative to the draw-off shaft.

If now the draw-off rotates, then the intermediate rings rotate synchronously with the draw-off shaft whilst the roller elements, which are supposed to draw the knitting downwardly, are variously influenced by this. Since differing draw-off forces appear across the entire working width of the cloth draw-off roller, as a result of the interposed tension springs, the draw-off rollers rotate asynchronously with respect to the draw-off shaft over a predetermined region and the various knitting tensions, occurring over the entire width of knitting, are equalised.

In the unloaded condition of the cloth draw-off roller, a degree of play exists between the roller elements and the intermediate rings so that each roller element can rotate differentially through a predetermined rotational angle independently of the neighbouring roller element and maintained in rotational tension by the tension spring of the relevant intermediate ring. The knitting now has the tendency, according to the type of stitch, in most cases to contract in width so that axial forces are applied to the roller elements and the roller elements are pushed together via the intermediate rings. As a result, non-uniform rotational friction results so that the neighbouring roller elements cannot correctly perform equalisation. That is to say, if a roller element is rotationally displaced by the knitting and by the relevant tension spring, as a result of the frictional force occurring at the neighbouring roller element, it is either rotated in common with the roller element or hinders the roller element from rotating.

The invention is based on the object of providing a cloth draw-off roller of the type described in the introduction in which neighbouring roller elements can operate completely mutually independently and thus do not mutually interact.

This object is achieved according to the invention in that means are provided which establish and ensure a minimum spacing between the axially opposed surfaces of sequential intermediate rings, which spacing is larger than the axial spacing of the two faces of the respect roller elements coming into contact with these surfaces.

By means of this construction it is achieved that axial pressure can be transferred by each roller element only onto one intermediate ring and not onto one or more neighbouring roller elements and thus the mutual interaction of the roller elements is completely prevented.

Preferably, the intermediate rings are rigidly connected to the draw-off shaft for preventing displacement in the axial direction. They can be screwed or pinned to the draw-off shaft.

A further advantageous embodiment of the invention consists in that between the intermediate rings are provided axially extending distance members abutting the intermediate rings.

The distance members can be keying members inserted into a key slot of the draw-off shaft into which engage lugs of intermediate rings, and the keying members may abut the lugs.

Alternatively, it is also possible that the distance members are tubular members mounted on the draw-off shaft.

Figure 2:
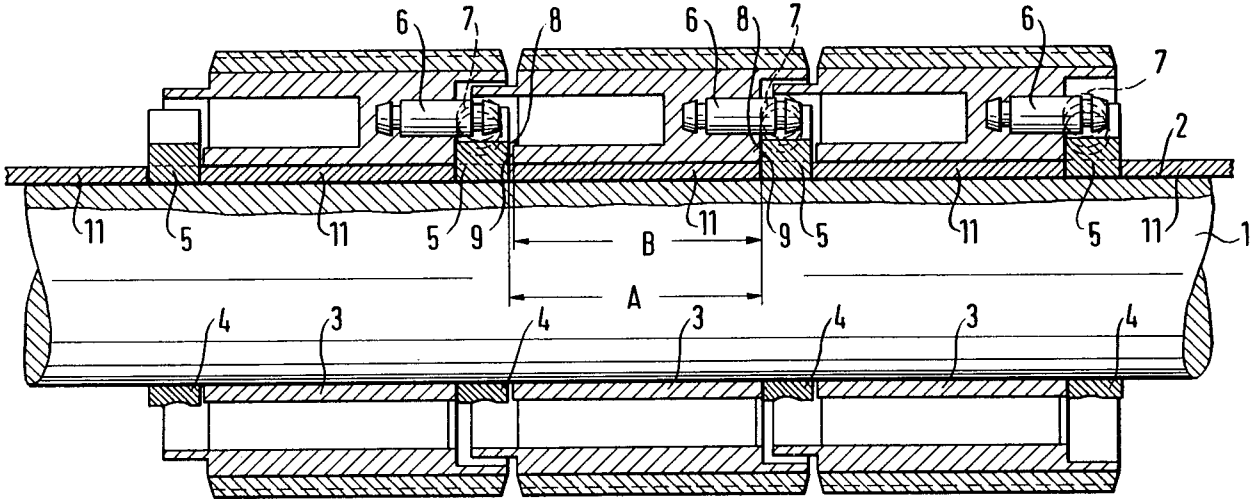

Exemplary embodiments of the invention will be described in more details in the following with reference to the drawing in which:

FIG. 1 shows a longitudinal section through a part of a cloth draw-off roller according to the invention having intermediate rings rigidly connected to the draw-off shaft; and FIG. 2 shows a longtitudinal section as in FIG. 1 but with distance members arranged between the intermediate rings.

The cloth draw-off rollers illustrated in FIGS. 1 and 2 each have a respective draw-off shaft 1 provided with a key slot 2. Roller elements 3 are pushed onto the draw-off shaft 1 for rotation relative thereto. Intermediate discs or intermediate rings 4 are pushed onto the draw-off shaft 1 at points axially between the roller elements 3 and overlapped by roller elements 3, one intermediate ring 4 being assigned to each roller element 3. Each intermediate ring 4 has a lug 5 which extends into the key slot 2 and ensures a rotational connection between the intermediate ring 4 and the draw-off shaft 1. Each roller element 3 is provided with a pin 6 into which a torsion spring or tension spring 7 is suspended. The tension spring 7 is connected at its other end to the intermediate ring 4 assigned to the respective roller element 3. Thus, the individual short sprung roller elements 3 can rotate through a predetermined rotational angle relative to the draw-off shaft 1 under spring loading and under loading from various knitting tensions.

If the rotational shaft 1 rotates during draw-off of knitting, then the intermediate rings 4 rotate synchronously therewith as a result of the engagement of their lugs 5 into the key slot 2. Since differing draw-off forces are applied to the individual roller elements across the working width of the cloth draw-off roller, the roller elements 3 rotate relative to the draw-off shaft 1 as a result of their spring loading and under the influence of the various knitting tensions to produce equalisation.

Since the knitting tends in many cases, according to the stitch, to shrink in width, also additional axial forces are however applied to the roller elements 3 which tend to cause the roller elements 3 and intermediate rings 4 to abut one another.

In order to prevent frictional force resulting from the axial movements of the roller elements 3 on the draw-off shaft 1, which friction is transferred from one roller element 3 to the others and thus affects the roller elements 3 in their mutual operation, means are provided which establish and ensure a minimum spacing A between mutually facing surfaces 8 of axially sequential intermediate rings 4, which spacing is larger than the axial spacing B of the two faces 9 of the respective roller element 3 coming into contact with these surfaces 8.

In the draw-off roller illustrated in FIG. 1, these means consist in that the intermediate rings 4 are screwed or pinned at 10 to the draw-off shaft 1 in such manner that sequential intermediate rings 4 have a minimum axial spacing A. As a result, the intermediate rings 4 are rigidly connected to the draw off shaft 1 so that they can absorb the lateral axial forces of the roller elements 3 and these can no longer be transferred to neighbouring roller elements 3.

FIG. 2 shows a cloth draw-off roller in which, in order to achieve the desired minimum spacing A between the intermediate rings 4, distance members 11 are inserted in the form of keying members into the key slot 2 in such manner that they extend in each case from lug 5 to lug 5 of sequential intermediate rings 4. In assembly, the entire longitudinal combination is pushed together and abuts the lugs 5 and distance members 11 and for example is fixed by means of external setting rings. The fixing can also be achieved by means of a rigid connection of external intermediate rings 4 to the draw-off shaft 1.

The distance members 11 are longer than the bearing regions of the roller elements 3. Thus, the roller elements 3 always have a degree of residual and unchanging play.

If now a lateral force is applied by the knitting, then the roller elements 3 push onto the intermediate rings 4 which are also axially fixed by the distance members 11 and are rigidly secured to the draw-off shaft 1, and thus produce rotational friction without this being transferred to neighbouring roller elements 3.

The distance members 11 can also be constructed as tubular members mounted on the draw-off shaft 1, on which in turn the roller elements 3 are mounted. This embodiment is not illustrated in the drawing.

We claim:

1. Cloth draw-off roller for flat knitting machines comprising a plurality of roller elements rotatably mounted on a draw-off shaft and intermediate rings arranged between the roller elements with axial play relative thereto and overlapped by the roller elements, which intermediate rings are rigidly connected to the draw-off shaft and resiliently connected to respective roller elements, and means for establishing and ensuring a minimum spacing between mutually facing surfaces of axially sequential intermediate rings, which spacing is larger than the axial spacing of the two faces of the respective roller element coming into contact with these surfaces.

2. Cloth draw-off roller according to claim 1 wherein the intermediate rings are rigidly connected to the draw-off shaft to prevent displacement in the axial direction.

3. Cloth draw-off roller according to claim 2 wherein the intermediate rings are screwed to the draw-off shaft.

4. Cloth draw-off roller according to claim 2 wherein the intermediate rings are pinned to the draw-off shaft.

5. Cloth draw-off roller according to claim 1 wherein between the intermediate rings are provided axially extending distance members abutting the intermediate rings.

6. Cloth draw-off roller according to claim 5 wherein the distance members are keying members inserted into a key slot of the draw-off shaft into which lugs of the intermediate rings engage, the keying members abutting the lugs.

7. Cloth draw-off roller according to claim 5 wherein the distance members are tubular members mounted on the draw-off shaft.

* * * * *

UNITED STATES PATENT AND TRADEMARK OFFICE
CERTIFICATE OF CORRECTION

PATENT NO. : 4,777,808

DATED : October 18, 1988

INVENTOR(S) : Gottfried KUHNERT

It is certified that error appears in the above-identified patent and that said Letters Patent is hereby corrected as shown below:

Title page:

[73] Assignee: Universal Maschinenfabrik Dr.Rudolf Schieber GmbH & Co. KG.
Federal Republic of Germany Signed and Sealed this Third Day of October, 1989

*Attest:*

*Attesting Officer*

DONALD J. QUIGG

*Commissioner of Patents and Trademarks*